US009635959B1

(12) United States Patent
Ali et al.

(10) Patent No.: US 9,635,959 B1
(45) Date of Patent: May 2, 2017

(54) RETAIL DISPLAY HANGER

(71) Applicants: Terry Ali, Fairborn, OH (US); Christopher Ali, Beavercreek, OH (US); Frank Ali, Xenia, OH (US); Wayne Carl Leblanc, Enon, OH (US)

(72) Inventors: Terry Ali, Fairborn, OH (US); Christopher Ali, Beavercreek, OH (US); Frank Ali, Xenia, OH (US); Wayne Carl Leblanc, Enon, OH (US)

(73) Assignee: ALI INDUSTRIES, INC., Fairborn, OH (US)

( * ) Notice: Subject to any disclaimer, the term of this patent is extended or adjusted under 35 U.S.C. 154(b) by 0 days.

(21) Appl. No.: 15/153,675

(22) Filed: May 12, 2016

(51) Int. Cl.
*A47K 1/08* (2006.01)
*A47F 7/28* (2006.01)
*A47F 5/00* (2006.01)

(52) U.S. Cl.
CPC ..... *A47F 7/28* (2013.01); *A47F 5/0006* (2013.01)

(58) Field of Classification Search
USPC ..... 248/312
See application file for complete search history.

(56) References Cited

U.S. PATENT DOCUMENTS 1,670,204 A * 5/1928 Moore ..... G09F 5/042 206/372
3,045,961 A * 7/1962 Cygan ..... A47F 5/0846 248/220.42
4,247,003 A * 1/1981 Jones ..... G09F 1/02 206/486
D275,074 S * 8/1984 Villanueva ..... 206/526
4,483,502 A 11/1984 Fast
5,048,676 A * 9/1991 Borgis ..... B65D 71/16 206/418
5,131,542 A * 7/1992 Stenstrom ..... B65D 71/10 206/476
5,284,259 A 2/1994 Conway et al.
5,405,022 A 4/1995 Rissley
5,477,964 A * 12/1995 Hart ..... B65D 73/0021 206/349
5,794,800 A * 8/1998 Carmo ..... A47F 7/005 211/113
5,915,564 A * 6/1999 Hsi-Chang ..... B65D 73/0085 206/299
D412,110 S * 7/1999 Cornwell ..... D9/415
6,286,690 B1 * 9/2001 Thalenfeld ..... A47F 5/0006 211/113
6,659,278 B1 12/2003 Velliquette
6,681,932 B2 * 1/2004 Bradfield ..... B25H 3/006 206/349
7,624,865 B2 * 12/2009 Pendergraph ..... B65D 73/0064 206/349
7,762,511 B1 * 7/2010 Liebers ..... A47F 5/0006 206/5
7,823,851 B2 * 11/2010 Chen ..... F16B 45/00 248/301
2004/0245792 A1 12/2004 Berish et al.
2006/0145041 A1 * 7/2006 Wagenknecht ..... B65D 23/003 248/312

(Continued)

*Primary Examiner* — Monica Millner
(74) *Attorney, Agent, or Firm* — R. William Graham

(57) ABSTRACT

A retail display hanger for supportively displaying a fluid container and a secondary component, where the fluid container has a neck, typically threaded, with a cap, which is likewise complementary threaded.

8 Claims, 3 Drawing Sheets

(56) References Cited

U.S. PATENT DOCUMENTS

| | | | | |
|---|---|---|---|---|
| 2014/0166515 | A1* | 6/2014 | Nguyen | B65D 75/367<br>206/368 |
| 2015/0196141 | A1* | 7/2015 | Rohrig | B65D 73/0085<br>248/318 |

* cited by examiner

RETAIL DISPLAY HANGER

BACKGROUND OF THE INVENTION

1. Field of Invention

This invention relates generally to hanging devices for display, and more particularly to a retail display hanger for supporting and displaying a fluid dispenser of the type having a container filled or fillable with a fluid and a dispensing closure with a removable protective cap and a secondary component.

2. Prior Art

Retail display hang tag devices for products plays a significant role in marketing. Products must be easily viewed in a manner which is economical and conserve shelf space. Thus, providing the product(s) in a hanging arrangement for customers to quickly see and discern the usefulness or utility of the product being displayed, sales will typically be greater.

There have been some prior devices to display tubes or bottles using a hang tag. These typically require insertion of a neck into a hole of a tag and then securing the cap to sandwich a portion of the tag. Maintaining the cap tightly sealed to the tube or bottle is important, and thus the removal of the cap and replacement thereof is an extra step and not ideal.

Additionally, some of these require use of additional securing means to maintain the product in a generally vertical position. Typically, such fluid containers are stacked upright on a shelf or placed into boxes or packages for similar stacking arrangements. In this case, it is more difficult in discerning the contents and utility of such a product and potential customers browsing shelves have difficulty finding the location of the product in packaging or containers. Product which can be easily hung from display wires or hooks and easily viewed by retail customers are more likely to sell.

The present invention provides a retail display hanger for supportively displaying a fluid container and a secondary component, where the fluid container of the type having a container which is filled or fillable with a fluid to be dispensed from a dispensing end with a removable cap. The device is economical, easily manufactured in a generally flat configuration with bendable portions for attachment to the fluid container and secondary component which supports the fluid container and secondary component in an upright orientation attached to a conventional display hanger or hook.

BRIEF SUMMARY OF THE INVENTION

It is an object to provide a retail display hanger which will supportively display a fluid container and secondary component on a retail hook or peg.

It is another object of the invention to provide an economical retail display hanger which is readily attachable to a fluid container and secondary component and which also maintains the items in a generally vertical position for viewing and reading printed retail indicia thereon.

Accordingly, the instant invention is directed to a retail display hanger for supportively displaying a fluid container and a secondary component, where the fluid container has a neck, typically threaded, with a cap, which is likewise complementary threaded. The retail display hanger includes a panel having an upper portion and a lower portion joined at respective first ends and second ends by way of living hinges. The lower portion includes a tongue extending between its first end and second end into a complementary formed inner open surface of the upper portion which includes an eyelet recess for a retail display hanger or hook. The tongue includes a first open surface to press fit receive a portion of the second component. A second open surface extends partway into the tongue and part way into a remainder of the lower portion. The second open surface provides a configuration of a size greater than the neck and smaller than the cap. The second open surface includes at least one, preferably several, radially extending slits which serve to permit the second open surface to widen thereby permitting the cap to be press fit therethrough until reaching the neck where the second open surface resumes its normal position about the neck of the container to retain the same. The upper portion can pivot about 90° about the living hinges to assume a normal position medially over the second open surface. The secondary component can preferably have one end which can be press fit through the first open surface to be retained therein, such as a tube end which is temporarily deformable. In this way, the eyelet recess can be used to hang the items for display on a hook for example.

In accordance with these and other objects which will become apparent hereinafter, the instant invention will now be described with reference to the accompanying drawings.

DETAILED DESCRIPTION OF THE INVENTION

Figure 1:
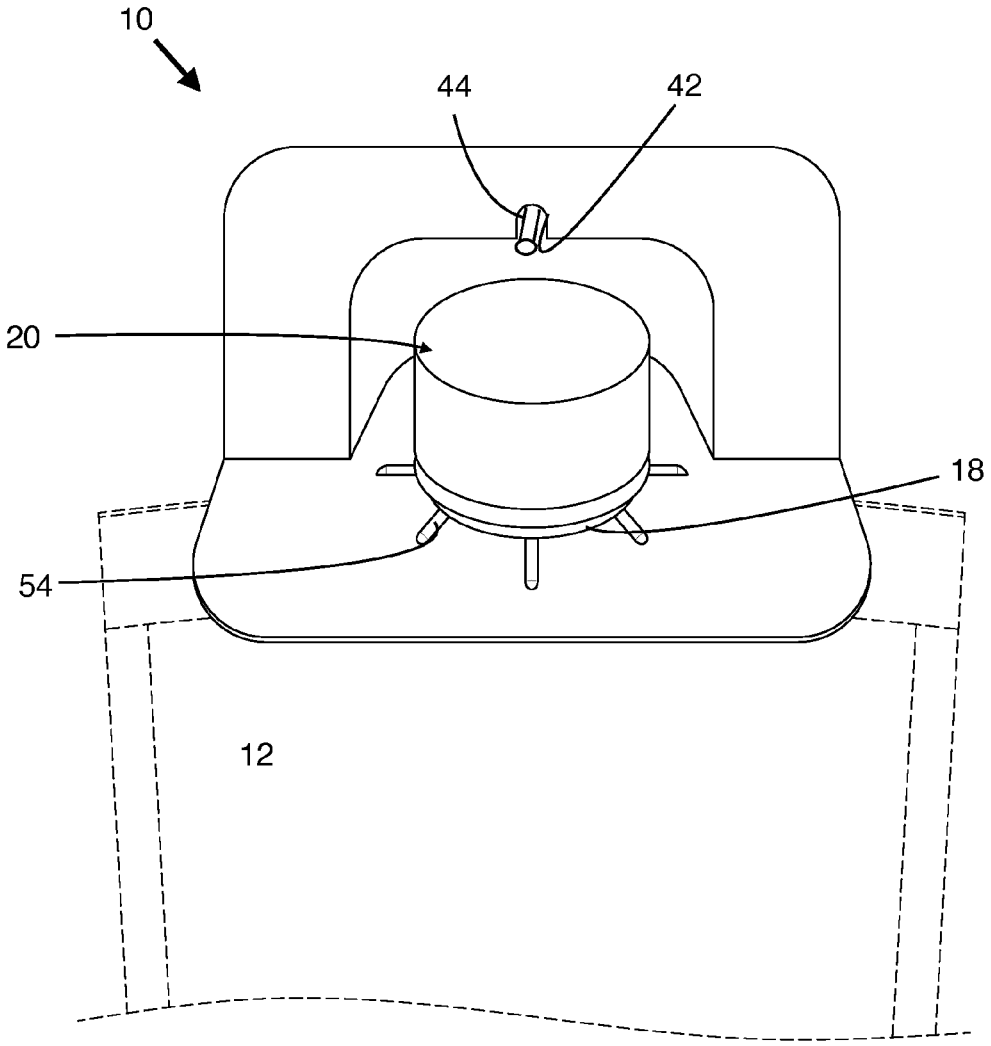
FIG. 1 is a front perspective view of the invention in use.

Referring now to the drawings, the retail display hanger of the invention is shown generally by a numeral 10. The retail display hanger 10 for supportively displaying a first component, e.g., a fluid container 12 and a second component 14. The fluid container 12 is of the type having a lower vessel 16 for receiving a fluid material. The vessel 16 terminates in an upper neck 18, which is commonly threaded, and a removable cap 20, which is likewise complementary threaded.

The retail display hanger 10 includes a panel 20 having an upper portion 22 and a lower portion 24 joined at respective first ends 26, 28 and second ends 30, 32 by way of living hinges 34, 36. The lower portion 24 includes a tongue 38 extending between its first end 28 and second end 32 into a complementary formed inner open surface 40 of the upper portion 22 which includes an eyelet recess 42 for a retail display arm or hook 44.

The tongue 38 includes a first open surface 46, here shown to be oblong, to press fit receive an end portion 48 of the second component 14, e.g. a tube end. A second open surface 50 extends partway into the tongue 38 and part way into a remainder 52 of the lower portion 24. The second open surface 50 provides a configuration of a first size greater than a diameter of the neck 18 and smaller than the cap 20 and a second size greater than a diameter of the cap 20 due to slits 54 and widening as cap 20 is press fit therethrough.

The second open surface 50 includes at least one, preferably a plurality of, radially extending slit(s) 54 which serve to permit the second open surface 50 to widen to the second size thereby permitting the cap 20 to be press fit therethrough until reaching the neck 18 where the second open surface 50 resumes its normal position or first size about the neck 18 of the container 12 to retain the same. The upper portion can pivot 90° about the living hinges 34, 36 to assume a normal position medially over the second open surface 50. The secondary component 14 in this example is a plastic tube filled with a fluid material and can preferably have one end 48 which can be press fit through the first open surface 46 to be retained therein. The tube end 48 is temporarily deformable. The eyelet recess 42 can be used to hang the items for display on a hook 44 for example as seen in FIG. 1.

Figure 2:
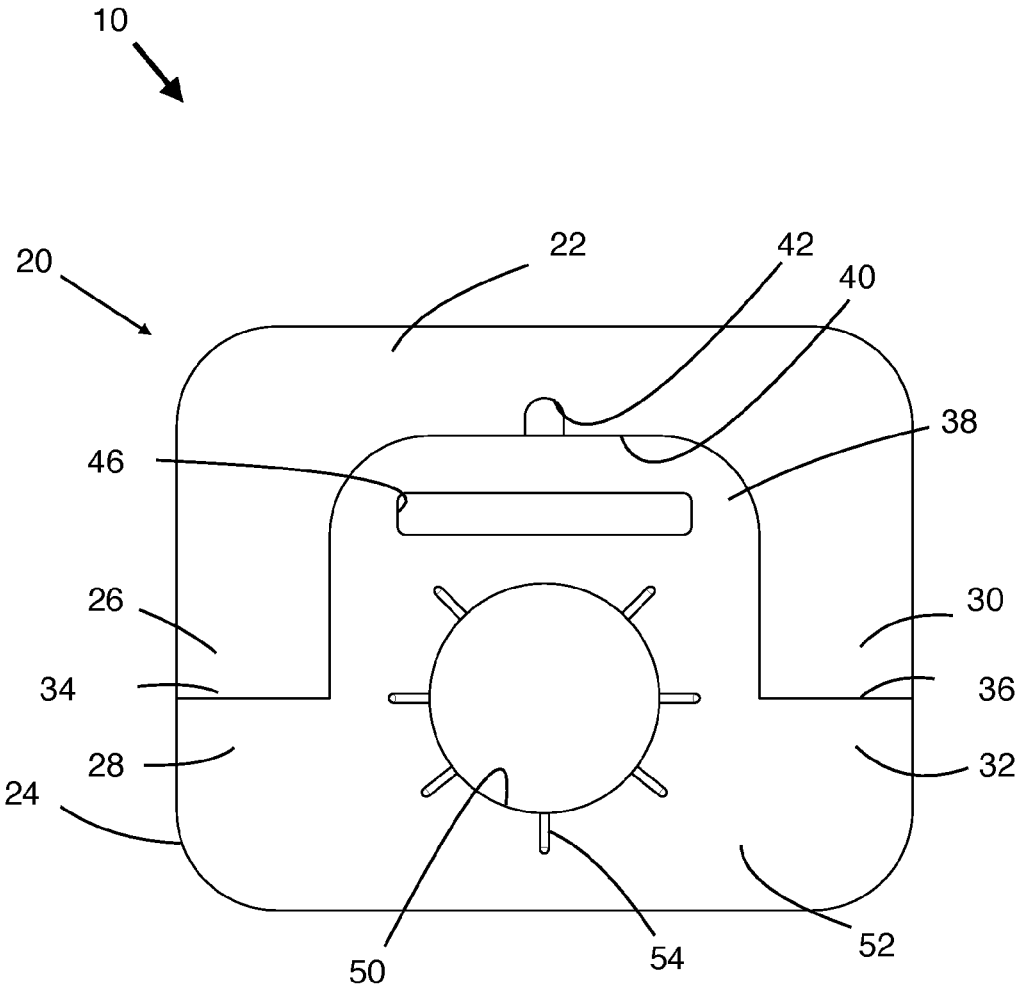
FIG. 2 is a plan view of the invention shown in FIG. 1.
Figure 3:
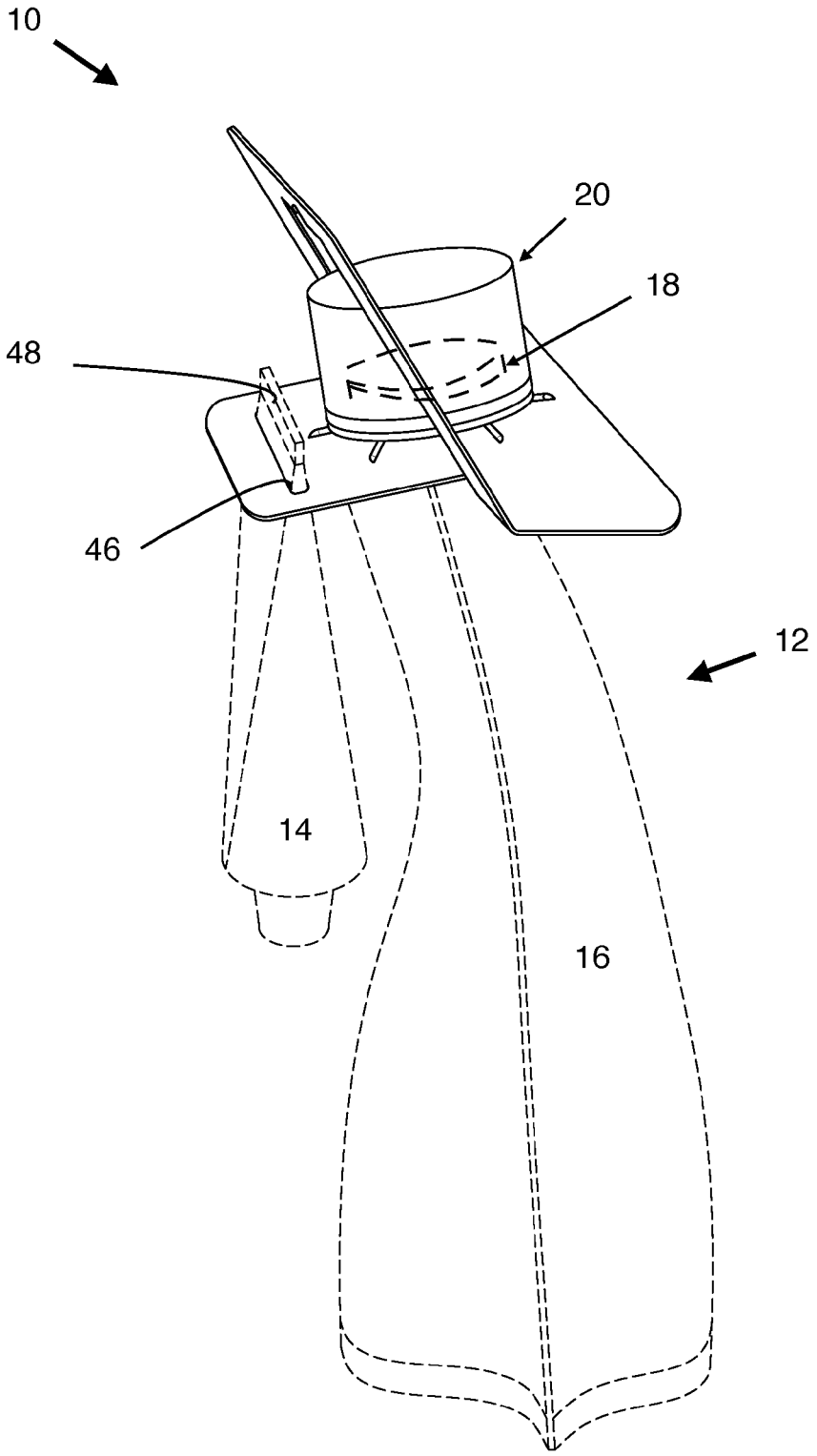
FIG. 3 is a side perspective view of the invention of FIG. 1 in its in-use position attached to and supporting a fluid container and a secondary component.

The panel 20 is generally flat molded plastic formed as a single unit. The panel 20 shown here is generally square, with living hinges 34, 36 extending medially therein defining the upper portion 22 and lower portion 24. The panel 12 provides a surface for additional retail display indicia if so desired. The retail display hanger 10 is manufactured of molded plastic in the flat as best seen in FIG. 2.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A retail display hanger for supportively displaying a first component including a fluid component and a second component, which includes:

a first component having a neck with a removable cap;

a second component having a first end and a second end;

a plastic panel having an upper portion and a lower portion joined at respective first ends and second ends by way of hinged portions, said lower portion includes a tongue extending between said first end and said second end of said lower portion and into a complementary formed inner open surface of said upper portion which includes an eyelet recess for a retail display arm, said tongue includes a first open surface to press fit receive a portion of the said second component, and a second open surface extends partway into said tongue and part way into a remainder of said lower portion, said second open surface provides a configuration having a first size greater than the neck and smaller than said cap and once about said neck, supports said first component, and said first open surface and said second open surface extend at least in part from opposite sides of said panel when receiving said second component and said first component therein.

2. The retail display hanger of claim 1, wherein said second open surface includes at least one radially extending slit which serves to permit said second open surface to widen to a second size permitting said cap to be press fit therethrough until reaching the neck where said second open surface resumes said first size about said neck of said first component to retain the same.

3. The retail display hanger of claim 2, wherein said upper portion pivots about 90° at said hinges to assume a normal position medially over said second open surface.

4. The retail display hanger of claim 2, which includes a plurality of radially extending slits.

5. A retail display hanger for supportively displaying a first component including a fluid container and a second component, where the fluid container has a neck with a removable cap, which includes:

a fluid container having a neck with a removable cap;

a second component having a first end and a second end;

a plastic panel having an upper portion and a lower portion joined at respective first ends and second ends by way of hinged portions, said lower portion includes a tongue extending between said first end and said second end of said upper portion and into a complementary formed inner open surface of said lower portion which includes an eyelet recess for a retail display arm, said tongue includes a first open surface to press fit receive a portion of the second component, and a second open surface extends partway into said tongue and part way into a remainder of the lower portion, said second open surface provides a configuration having a first size greater than said neck and smaller than said cap to receive said neck below said cap and supports said first component, and said first open surface and said second open surface extend at least in part from opposite sides of said panel when receiving said second component and said first component therein.

6. The retail display hanger for supportively displaying a first component including the fluid container and the second component of claim 5, wherein said second open surface includes at least one radially extending slit which serves to permit said second open surface to widen to a second size permitting said cap to be press fit therethrough until reaching said neck where said second open surface resumes said first size about said neck of said fluid container to retain said container.

7. The retail display hanger for supportively displaying a first component including the fluid container and the second component of claim 6, wherein said upper portion pivots about 90° at said hinges to assume a normal position medially over said second open surface.

8. The retail display hanger for supportively displaying a first component including the fluid container and the second component of claim 6, which includes a plurality of radially extending slits.

* * * * *